United States Patent [19]

Tekatch et al.

[11] Patent Number: 4,830,666

[45] Date of Patent: May 16, 1989

[54] REMOVAL OF NITROGEN FROM IRON

[76] Inventors: William M. Tekatch, 19 Pheasant Place, Hamilton, Ontario, Canada, L9A 4Y4; Karol J. Balaz, 339 East 14th Street, Hamilton, Ontario, Canada, L9A 4C1

[21] Appl. No.: 189,022

[22] Filed: May 2, 1988

[51] Int. Cl.[4] ..... C21C 7/00
[52] U.S. Cl. ..... 75/59.3
[58] Field of Search ..... 75/59.3

[56] References Cited

U.S. PATENT DOCUMENTS 1,481,747 1/1924 Saltrick ..... 75/59.31
2,874,038 2/1959 Ruhenbeck ..... 75/59.31

*Primary Examiner*—Peter D. Rosenberg
*Attorney, Agent, or Firm*—McConnell and Fox

[57] ABSTRACT

A method of reducing the nitrogen content in iron and iron alloys comprises introducing hydrogen into the melt in the form of a gas or hydrogen compound in sufficient quantity and for a sufficient time to reduce the nitrogen content and subsequently treating the melt to reduce the hydrogen content. The hydrogen may be mixed with an inert gas to minimize the risk of explosion.

24 Claims, No Drawings

REMOVAL OF NITROGEN FROM IRON

FIELD OF THE INVENTION

This invention relates to means for reducing the nitrogen content of iron, steel and their alloys.

DESCRIPTION OF THE PRIOR ART

It has been appreciated for some time that the level of nitrogen present in steel has an effect on its quality. The lower one can reduce the nitrogen content, the better the drawing qualities of the steel. Efforts have been made to reduce the nitrogen content to 10 parts per million and the reduction to 5 parts per million would be preferable.

In attaining this end, various processes have been proposed. For example, it has been proposed to inject an inert gas such as argon into molten steel. When this is done, the nitrogen in the steel will approach equilibrium with the nitrogen in the inert gas. Thus, the nitrogen moves from the liquid steel into the inert gas and the inert gas may then be removed and the total nitrogen content of the steel is consequently reduced.

In a similar manner, gas such as carbon monoxide can be created by the introduction of iron ore to the molten steel. The oxygen in the iron ore converts part of the carbon in the steel to carbon monoxide. Gas bubbles so formed are substantially inert and, once again, the partial pressure causes transference of nitrogen from the steel to the pockets of carbon monoxide which may then be removed and the mixture of carbon monoxide and nitrogen being removed reduces the nitrogen content of the steel.

A further process which has been proposed in the past is to vacuum treat the liquid steel which simply removes the nitrogen as a gas directly from the liquid steel.

All of these processes have certain limitations. In particular, the vacuum process is relatively expensive and the inert gas process has limited application since it becomes expensive to supply sufficient gas to reduce the nitrogen to a level as low as may be desired.

SUMMARY OF THE INVENTION

In accordance with this invention, the liquid steel is exposed to hydrogen or to a hydrogen source such as a hydrocarbon. The hydrogen may be introduced either as an ambient atmosphere around the liquid steel or may be passed through the steel by various processes, such as through a lance with its end submerged in the molten metal or introduction through a porous plug or tuyere at the base of the vessel. The hydrogen source may be plain hydrogen, various hydrocarbons or metal hydrides; however, the hydrogen source should not contain sulfur, nitrogen or excess oxygen. Therefore, water, steam, hydrogen sulfide, ammonia and the like are not suitable. The hydrogen source may be a mixture including materials other than hydrogen so long as they themselves do not contain sulfur, nitrogen or excess oxygen, excess oxygen is that amount which, under the process conditions, leaves no free hydrogen.

In operation, the hydrogen, directly or from the decomposition of the hydrogen source, functions as a substantially inert gas and bubbles to the surface of the steel. Because hydrogen sources are relatively cheap, the process can be carried on until the nitrogen level is reduced to the desired concentration and it is quite simple to reduce the nitrogen level to 5 parts per million. Hydrogen may also be introduced as a component in an inert gas mixture either pre-mixed or formed in situ, for example, the hydrogen may be mixed with argon to minimize hydrogen content of the steel. In this process inert gases may include helium, neon, argon, krypton, xenon, steam and carbon monoxide. Improvements may be made to the resulting steel by reduction of the hydrogen content if the steel is subsequently processed in a basic oxygen furnace or is vacuum degassed.

In the prior art, such as U.S. Pat. No. 2,874,038, it has been known to introduce hydrogen into molten iron. The purpose, however, was to reduce the oxides and introduction of hydrogen was stopped as soon as the process ceased to be exothermic. No effort was made to determine nitrogen content before or after introduction of the hydrogen and the process was stopped before useful reduction of nitrogen could occur.

DESCRIPTION OF THE PREFERRED EMBODIMENT

An iron melt is subjected to a flow of argon containing at least enough hydrogen to cause the reduction of nitrogen to the desired concentration in the metal. About 1000 parts by volume of the gas mixture is passed through the melt for each part of iron. The iron is then processed in a normal basic oxygen process to reduce the carbon and hydrogen content. The melt may then proceed through the normal steel-making process.

Examples typical of the prior art introduction of an inert gas and the results using our invention are provided below. In each example the original iron contained:

Carbon: 4.5% (standard deviation 0.1%)
Sulfur: 0.028%
Oxygen: 208 parts per million (standard deviation 44 ppm)
Nitrogen: 55.5 parts per million (standard deviation 1.9 ppm)

EXAMPLE #1 (Prior Art)

1 part iron and 1000 parts argon by volume were heated at atmospheric pressure to just above the melting point of the metal, held at that temperature for 15 minutes, then cooled. The resulting material contained the following:

Carbon: 4.4%
Sulfur: 0.03%
Oxygen: 68 parts per million (standard deviation 26 ppm)
Nitrogen 11.64 parts per million (standard deviation 0.63 ppm)

EXAMPLE 190 2

1 part iron and 1000 parts hydrogen by volume were heated at atmospheric pressure to just above the melting point of the metal, held at that temperature for 15 minutes, then cooled. The resulting material contained the following:

Carbon: 4.3%
Sulfur: 0.022%
Oxygen: 91 parts per million (standard deviation 20 ppm)
Nitrogen: 2.34 parts per million (standard deviation 0.65 ppm)

EXAMPLE #3

1 part iron and 1000 parts argon by volume were heated at atmospheric pressure to 940° C. Then 25 parts of hydrogen were introduced. Heating continued to just above the melting point of the metal, held at the temerature for 15 minutes, then cooled. The resulting material contained:

Nitrogen 4.46 ppm (standard deviation 0.62 ppm)

It will be seen that while the prior art process of using argon produced a reduction of nitrogen of 79%, the process of this invention using pure hydrogen as in Example #2, produced a reduction of nitrogen of about 96%.

It appears from Example #3 that mixtures of hydrogen and an inert gas such as argon will be somewhat less effective than pure hydrogen. But mixtures except those including the addition of only carbon monoxide reduce the hazard of forming an explosive mixture which might be produced if pure hydrogen was used in a commercial process. Concentrations of 1% by volume of hydrogen or more appear to produce the best results, but concentrations as low as 0.1% by volume appear to be effective. Below 0.1% the hydrogen does not appear to be particularly beneficial.

The underlying principles of the process are not fully understood, but it appears that the hydrogen does not function in the same manner as an inert gas and cause transfer of nitrogen solely because of the partial pressure of the nitrogen in the melt versus the partial pressure of nitrogen in the gas mixture. If this were the mode of operation, the results of Example #2 should more closely compare to the results of Example #1.

Increased gas pressure, that is pressure above atmosphereic, in the melt would seem to be beneficial in reducing the nitrogen content. Reduced pressure at the surface of the melt on the other hand would tend to reduce hydrogen retention. These seemingly conflicting conditions may be obtained by introducing hydrogen, by lance or porous plug for example, at the bottom of the melt where the liquid head of the melt will increase the gas pressure and at the same time creating a subatmospheric ambient pressure above the melt.

It should also be understood that other inert gasses might be used, such as helium, but economics would seem to indicate that argon is the most practical additive to the hydrogen. The addition of inert gas not only reduces the hazard of explosion but may also reduce the amount of hydrogen which has to be subsequently removed from the melt.

We claim:

1. A process for reducing the undesirable components in a molten metal comprising introducing hydrogen into the melt in volume sufficient to complete any exothermic reaction and then continuing introduction of hydrogen until the components are reduced to the desired level.

2. A process according to claim 1 wherein the molten metal is iron.

3. A process according to claim 1 wherein the hydrogen is introduced in the form of a hydrogen containing compound which decomposes at the temperature of the molten metal.

4. A process according to claim 1 wherein the hydrogen is introduced as a gas mixed with an inert gas.

5. A process according to claim 4 wherein the mixed gas is introduced in an amount equal to 1000 parts gas by volume for each part of molten metal.

6. A process according to claim 3 wherein the molten metal is iron.

7. A process according to claim 4 wherein the molten metal is iron.

8. A process according to claim 1 wherein the undesired component is nitrogen.

9. A process according to claim 1 wherein undesired component is arsenic.

10. A process according to claim 1 wherein the undesired component is phosphorus.

11. A process according to claim 1 wherein the undesired component is sulfur.

12. A process according to claim 1 wherein the source of hydrogen is a metal hydride.

13. A process according to claim 1 wherein the source of hydrogen is a hydrocarbon.

14. A process according to claim 1 wherein the molten metal is steel.

15. A process according to claim 1 wherein the molten metal is stainless steel.

16. A process according to claim 4 wherein the gas includes at least 1% hydrogen by volume and the remainder argon.

17. A process according to claim 5 wherein the gas includes at least 0.1% hydrogen by volume and the remainder argon.

18. A process for reducing the nitrogen content of molten iron and alloys thereof comprising:

(a) introducing hydrogen into the lower portion of the molten metal for a period of time sufficient to complete any exothermic reaction and then in such volume as to reduce the nitrogen content of the melt below 5 ppm;

(b) processing the resultant melt to reduce the hydrogen content.

19. A process as claimed in claim 18 wherein the hydrogen is introduced in a mixture with an inert gas and the total volume of gas introduced equals at least 1000 times the volume of molten metal.

20. A process as claimed in claim 18 wherein the hydrogen present in the gas mixture equals at least 0.1% by volume of the total gas introduced.

21. The process as claimed in claim 18 wherein the process to reduce the hydrogen content comprises reducing the ambient pressure at the surface of the melt.

22. The process as claimed in claim 18 wherein the process to reduce the hydrogen content comprises subjecting the melt to a basic oxygen process.

23. The process according to claim 1 wherein the pressure of hydrogen in the melt is substantially above atmospheric pressure.

24. The process according to claim 5 wherein the mixed gas is introduced in the melt at a pressure substantially above atmospheric pressure.

* * * * *

UNITED STATES PATENT AND TRADEMARK OFFICE

CERTIFICATE OF CORRECTION

PATENT NO. : 4,830,666

DATED : May 16, 1989

INVENTOR(S) : William M. Tekatch, et al.

It is certified that error appears in the above-identified patent and that said Letters Patent is hereby corrected as shown below:

Column 2, line 56, cancel "190" and substitute -- # --.
Column 3, line 36, cancel "phereic" and substitute -- pheric --.

Signed and Sealed this

Sixth Day of March, 1990

*Attest:*

JEFFREY M. SAMUELS

*Attesting Officer*

*Acting Commissioner of Patents and Trademarks*